United States Patent [19]

Peterson

[11] 4,075,467

[45] Feb. 21, 1978

[54] ILLUMINATED DRAFTING INSTRUMENT

[76] Inventor: John G. Peterson, 4731 W. Hoffman St., Kearns, Utah 84118

[21] Appl. No.: 632,470

[22] Filed: Nov. 17, 1975

[51] Int. Cl.[2] ..... F21V 33/00

[52] U.S. Cl. ..... 362/31; 362/109

[58] Field of Search ..... 240/2 E, 6.46, 2 D, 240/2 P, 2.1, 1 EL, 6.4 B; 33/112, 113

[56] References Cited

U.S. PATENT DOCUMENTS

| | | | |
|---|---|---|---|
| 2,643,326 | 6/1953 | Knapp | 240/2 D |
| 3,241,256 | 3/1966 | Viret et al. | 240/2.1 |

*Primary Examiner*—Fred L. Braun
*Assistant Examiner*—Peter S. Wong
*Attorney, Agent, or Firm*—B. Deon Criddle

[57] ABSTRACT

A drafting instrument using an internal light source to illuminate, via mirrors and glass beads and a plastic blade, the work area usually shaded by the draftsman, especially in the form of a T-square.

6 Claims, 4 Drawing Figures

ILLUMINATED DRAFTING INSTRUMENT

I have invented a new and novel means of illuminating T-squares and other drafting instruments using an internal light source to illuminate via mirrors and glass beads the work area that is usually shaded by the draftsman.

My invention can be understood in view of the accompanying figures.

Figure 1:
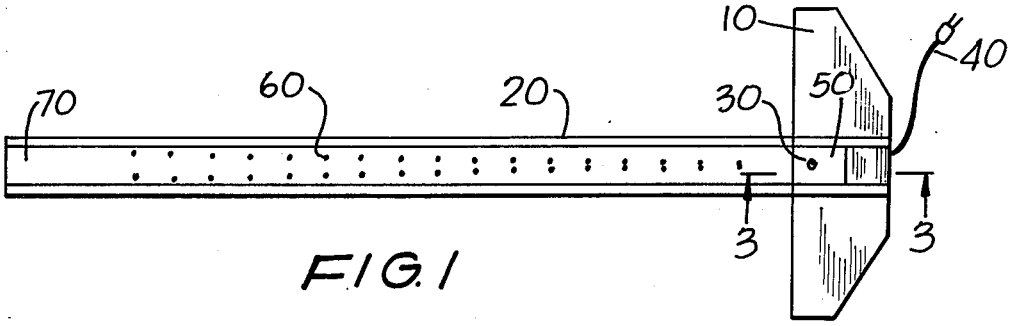
FIG. 1 is a top view of the square.
Figure 3:
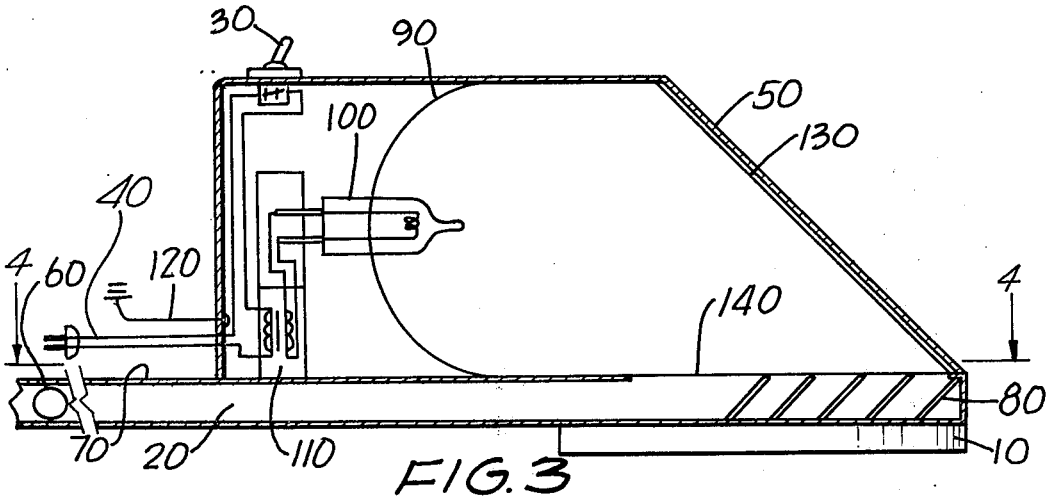
FIG. 3 is a cross section view through the front end of the T-square taken along the line 3—3 of FIG. 1.
Figure 4:
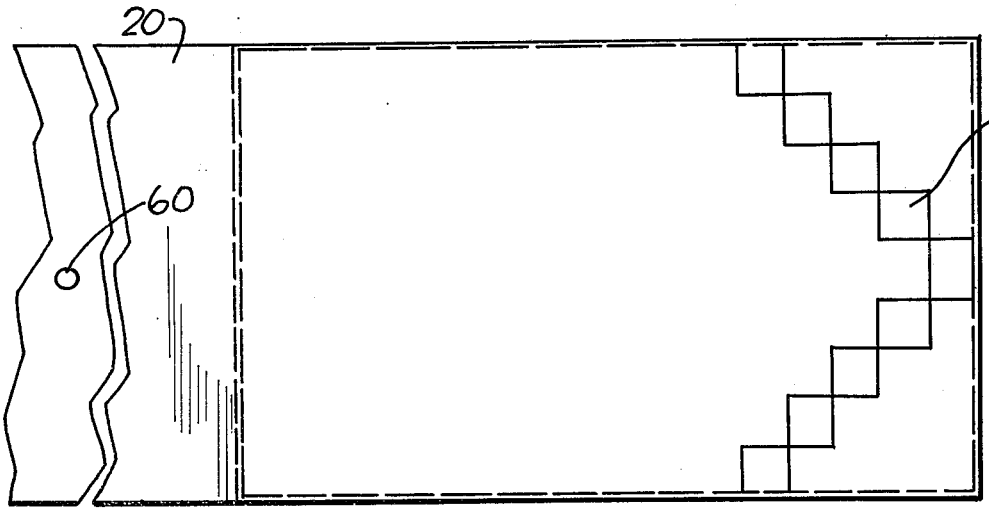

FIG. 4 is a view of the mirrors in the blade of the T-square taken along the plane 4—4 of FIG. 3. de In FIG. 1, a T-square top 10 has a blade 20 mounted on top of it. An on-off toggle switch 30 and a line cord and plug 40 are seen mounted on and connected to a housing 50 on the blade 20. Glass beads 60 are arranged in a V pattern along the blade. A strip painted black 70 covering most of the width of the blade is painted on a white paint layer which in turn is applied directly to the clear plastic blade 20 in which the beads 60 are embedded.

Figure 2:
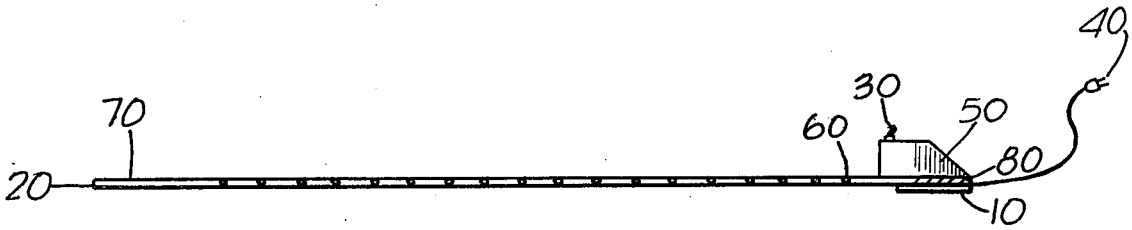
FIG. 2 is a side view of the square.

In FIG. 2, the blade 20 is mounted on the T-square top 10 with the beads 60 set in the paint 70 on the clear plastic of the blade 20. The mirrors 80 in the blade 20 and the housing 50 with the toggle switch 30 are visible.

In FIG. 3, the housing 50 painted black, has a reflector 90 with a lamp 100 mounted in it connected to a transformer 110 wired through the toggle switch 30 to a grounded 120 line cord 40. The black paint on white paint coat 70 prevents glare. The beads 60 are imbedded under the coat 70 making contact with the clear blade 20 so that light can be transmitted into the bead 60 and produce a diffused glow on the work from the edges of the blade 20. A mirror 130 reflects the light from the lamp 100 through a section of the blade 140 not covered with the painted coating onto a set of mirrors 80. The mirrors reflect the light down the length of the blade 20 to the beads. The top of the T-square 10 is beneath the blade.

In FIG. 4, the mirrors 80 are short pieces arranged in a V-pattern to reflect the light down the blade, so arranged as to maximize the light passing down the blade 20 in a pattern that will maximize the light hitting each bead 60.

Other drafting instruments in which my illumination method can be incorporated include: mechanical arms, parrallel rulers, and straight edges.

Having described a preferred embodiment of my invention, it is understood that various changes can be made without departing from the spirit of my invention, and I desire to cover by the appended claims all such modifications as fall within the true spirit and scope of my invention.

What I claim and seek to secure by Letters Patent is:

1. A drafting instrument comprising a top;

a blade projecting from said top, said blade being made of transparent material;

a reflective coating applied to at least a portion of an upper flat surface of the blade;

spaced apart clear beads along the length of the blade, beneath the reflective coating, said beads being in a generally V-shaped pattern and converging on the blade at a location adjacent to the top;

at least one angled mirror arranged to reflect light along the length of the blade;

light means carried by the blade, and light means being positioned to illuminate the angled mirror whereby light is reflected by the mirror along the length of the blade to the clear beads.

2. A drafting instrument as in claim 1, wherein the reflective coating applied to at least a portion of the blade comprises a coat of black paint applied over a layer of white paint, said black paint serving to reduce glare to a user.

3. A drafting instrument as in claim 1, wherein each said mirror is mounted in the blade.

4. A drafting instrument as in claim 3, wherein a plurality of mirrors are mounted in the blade to focus reflected light along the blade.

5. A drafting instrument as in claim 1, wherein the light means comprises a reflector to reflect light to each mirror;

a light bulb projecting through said reflector; and circuit means, including an on-off switch for operating said light bulb.

6. A drafting instrument as in claim 4, wherein the light means comprises a reflector to reflect light to each mirror;

a light bulb projecting through said reflector; and circuit means, including an on-off switch for operating said light bulb.

* * * * *